United States Patent [19]

Sanford

[11] Patent Number: 4,941,950

[45] Date of Patent: Jul. 17, 1990

[54] HEADBOX WITH GROOVED TRAILING ELEMENT

[75] Inventor: Charles L. Sanford, Beloit, Wis.

[73] Assignee: Beloit Corporation, Beloit, Wis.

[21] Appl. No.: 385,530

[22] Filed: Jul. 26, 1989

[51] Int. Cl.[5] ..... D21F 1/02

[52] U.S. Cl. ..... 162/343; 162/336; 162/344

[58] Field of Search ..... 162/336, 343, 344, 347

[56] References Cited

U.S. PATENT DOCUMENTS

| | | | |
|---|---|---|---|
| Re. 28,269 | 12/1974 | Hill et al. | 162/343 |
| 3,843,470 | 10/1974 | Betley et al. | 162/336 |
| 4,133,715 | 1/1979 | Hergert | 162/343 |
| 4,617,091 | 10/1986 | Rodel et al. | 162/343 |

*Primary Examiner*—Karen M. Hastings

*Attorney, Agent, or Firm*—Dirk J. Veneman; Raymond W. Campbell; David J. Archer

[57] ABSTRACT

In a headbox of a web forming apparatus, a trailing element device is disclosed for dividing a flow of stock flowing through a slice chamber of the headbox towards a slice lip of the headbox. The trailing element device includes a rectangular sheet having an upstream and a downstream end and a first and a second surface. The upstream end of the sheet is pivotally secured within the slice chamber for dividing the flow of stock into a first and a second current. The downstream end of the sheet freely floats adjacent to the slice lip such that the first current of stock flows past the first surface and the second current of stock flows past the second surface so that turbulence within the slice chamber is reduced. At least one of the surfaces defines a plurality of parallel-spaced grooves extending in a direction from the upstream and terminating short of the downstream end of the sheet for inhibiting the formation of machine direction vortices within the flow of stock that would otherwise cause streaking of the resultant web.

18 Claims, 4 Drawing Sheets

HEADBOX WITH GROOVED TRAILING ELEMENT

BACKGROUND OF THE INVENTION:

1. Field of the Invention:

The present invention relates to a trailing element device disposed within a headbox of a web forming apparatus. More particularly, the present invention relates to a trailing element device for dividing a flow of stock flowing through a slice chamber of the headbox towards a slice lip of the headbox.

2. Information Disclosure Statement:

In a papermaking machine, paper stock or furnish is supplied to a headbox which defines a slice chamber and a slice lip such that the stock is ejected from the slice lip onto a moving fourdrinier wire. Water is drained through the fourdrinier wire so that a web is formed on the upper surface of the wire.

In the formation of multi-layer webs, a first or primary headbox has been used to deposit a first layer of stock onto a moving fourdrinier wire. Subsequently, a secondary headbox disposed downstream relative to the primary headbox deposits a second layer of stock onto the first layer such that the first layer is sandwiched between the second layer and the fourdrinier wire.

More recently, with the introduction of the "STRATAFLO" headbox, a plurality of furnishes are supplied to a single headbox. "STRATAFLO" is a common law mark of Beloit Corporation. Such furnishes are each supplied between adjacent trailing elements disposed within the slice chamber of the "STRATAFLO" headbox.

The trailing elements of the "STRATAFLO" headbox are hingedly secured to the upstream end of the slice chamber and extend in a direction from the upstream end of the slice chamber towards the slice lip. Each of the elements freely floats within the slice chamber for reducing turbulence of the stock within the slice chamber. By this means, the different stocks are simultaneously ejected from the headbox and interface immediately downstream of the downstream end of the respective trailing elements.

In the formation of multi-ply webs using a "STRATAFLO headbox, a relatively cheap furnish is supplied as the lower or intermediate layer, and such cheap furnish is covered with a finer, more printable top layer.

With the aforementioned arrangement, a problem has been experienced in that during passage of the respective stocks along the surfaces of each trailing element, fluid vortices tend to form adjacent to the surfaces of the trailing element. The axes of such vortices are usually oriented in the flow direction, that is, the machine direction. These fluid vortices cause problems in the production of a multi-layered paper product in that when the headbox is supplied with a different furnish on either side of the trailing element, these vortices tend to lead to mixing of the two layers in such a way as to create a streaky appearance in the resultant web.

More particularly, since these vortices are large enough to fill the outer layer of the stock jet, they can quickly sweep material from the interface between the layers to the outer surface of the jet. This leads to the deposit of center layer material on the outer surface of the resultant web.

As such vortices can be initiated by such things as the wake downstream from a perforated plate or a tube bank, or by something as simple as a change in direction of the flow, it is very difficult to completely eliminate them from the headbox. The effect of such vortices may be minimized by setting the web quickly after the flow leaves the divider. However, such setting or drying of the web close to the headbox is not always a practical approach to the problem in view of the geometry of the forming equipment.

The present invention seeks to overcome the aforementioned problem by reducing the strength of machine direction vortices present in the flow between trailing elements. This is accomplished by modifying the surface of the elements so as to provide surface resistance to flow in a cross-machine direction without increasing the resistance in the machine direction. The aforementioned cross-machine resistance is created by cutting grooves in the surface of the trailing element or by applying small bars to the sheets, such bars being oriented in a machine direction. The objective of the invention is to dissipate the rotational energy of the vortices and to trigger the formation of smaller vortices from the large ones. The smaller vortices should dissipate the rotational energy faster by their interaction on each other. The smaller vortices reduce the scale of mixing within each portion of the stock jet, thereby minimizing the tendency of central material to migrate to the surface.

Therefore, it is a primary object of the present invention to provide a trailing element device that overcomes the aforementioned problems associated with the prior art proposals and which makes a considerable contribution to the art of forming a web from stock.

Another object of the present invention is the provision of a trailing element in which at least one of the surfaces of the trailing element defines a plurality of parallel-spaced grooves which extend in a direction from the upstream to the downstream end of the sheet for inhibiting the formation of machine direction vortices within the flow of stock that would otherwise cause streaking of the resultant web.

Another object of the present invention is the provision of a trailing element device in which a first current of a first stock is disposed on and flows past a first surface of the element and a second current of a second stock flows past a second surface of the element, the arrangement being such that formation of machine direction vortices along the surfaces is inhibited by a first and second plurality of grooves so that when the first and second stocks interface downstream relative to the downstream end of the sheet, migration between the stocks is minimized, thereby reducing streaking in the resultant web.

Another object of the present invention is the provision of a first plurality of grooves defined by a first surface of the trailing element and a second plurality of grooves defined by a second surface of the trailing element, the first plurality of grooves being offset relative to the second plurality of grooves such that rigidity of the sheet in a cross-machine direction is maintained.

Another object of the present invention is the provision of a trailing element in which, in addition to reducing the tendency for machine direction streaks to occur, the break-up of larger scale vortices into smaller scale structures improves the small scale orientation of fibers in the sheet and promotes stronger internal bonding.

Other objects and advantages of the present invention will be readily apparent to those skilled in the art by a consideration of the detailed description contained hereinafter taken in conjunction with the annexed drawings.

SUMMARY OF THE INVENTION:

The present invention relates to a trailing element device for dividing a flow of stock flowing through a slice chamber of a headbox towards a slice lip of the headbox. The trailing element device includes a rectangular sheet having an upstream and a downstream end and a first and a second surface. The upstream end of the sheet is pivotally secured within the slice chamber for dividing the flow of stock into a first and a second current. The downstream end of the sheet freely floats adjacent to the slice lip such that the first current of stock flows past the first surface and the second current of stock flows past the second surface so that turbulence within the slice chamber is reduced. At least one of the surfaces defines a plurality of parallel-spaced grooves which extend in a direction from the upstream to the downstream end of the element for inhibiting the formation of machine direction vortices within the flow of stock that would otherwise cause streaking of the resultant web.

In a more specific embodiment of the present invention, the sheet is fabricated from LEXAN and the upstream end of the sheet or element includes a bead which extends in a cross-machine direction. LEXAN is a registered trademark owned by General Electric Company. The bead is pivotally anchored within a channel which extends in a cross-machine direction along the headbox. The channel is disposed within the slice chamber so that the sheet is pivotally secured within the slice chamber.

In one embodiment of the present invention, the sheet is disposed within the slice chamber.

In another embodiment of the present invention, the downstream end of the sheet is disposed downstream relative to the slice lip.

In a preferred embodiment of the present invention, the first and second surfaces of the sheet define respectively a first and second plurality of parallel-spaced grooves, which extend in a direction from the upstream to the downstream end of the sheet for inhibiting the formation of machine direction vortices within the first and second currents respectively that would otherwise cause streaking of the resultant web.

The first current is of a first stock and the second current is of a second stock such that the sheet separates the first stock from the second stock. The arrangement is such that, formation of machine direction vortices along the surfaces is inhibited by the first and second plurality of grooves. When the first and the second stocks interface downstream relative to the downstream end of the sheet, migration between the stocks is minimized, thereby reducing streaking in the resultant web.

Each of the grooves of the first and second plurality of grooves has a depth which is less than the depth of the current flowing past the grooves in the vicinity of the downstream end of the sheet.

In one embodiment of the present invention, each of the grooves of the first and second plurality of grooves is of V-shaped configuration with the V-shaped grooves having an included angle within the range 80 to 100 degrees. Each of the V-shaped grooves has a depth within the range 0.03 to 0.05 inches and the grooves are spaced center to center within the range 0.12 to 0.13 inches from an adjacent groove.

In another embodiment of the present invention, each of the grooves is of rectangular configuration in a cross-machine direction.

In a further embodiment of the present invention, each of the grooves is of prismatic configuration in a cross-machine direction.

In one embodiment of the present invention, each of the grooves extend from the upstream end to the downstream end of the sheet.

In another embodiment of the present invention, each of the grooves extends from the upstream end of the sheet and terminates short of the downstream end of the sheet.

In a further embodiment of the present invention, each of the grooves extends from between the upstream and the downstream ends of the sheet to the downstream end of the sheet.

In another embodiment of the present invention, the grooves are formed by machining the sheet.

In a further embodiment of the present invention, the sheet is formed by a molding technique such that the grooves are integrally formed with the sheet.

In yet another embodiment of the present invention, the grooves are formed by extruding the sheet with the grooves formed therein.

In another embodiment of the present invention, the grooves are formed by etching the grooves into the sheet.

In another embodiment of the present invention, the grooves are formed by pressing a heated dye against the sheet in order to form the grooves therein.

In a preferred embodiment of the present invention, the first plurality of grooves are offset relative to the second plurality of grooves such that rigidity of the resultant sheet in a cross-machine direction is maintained.

Additionally, in a headbox of a web forming apparatus, a trailing element device separates a first current of the first stock from a second current of the second stock. The currents flow through a slice chamber of the headbox towards a slice lip of the headbox. The trailing element device includes a rectangular sheet having an upstream and a downstream end of the first and second surface. The upstream end of the sheet is pivotally secured within the slice chamber for separating the first stock from the second stock. The downstream end of the sheet freely floats within and adjacent to the slice lip such that the first current flows past the first surface and the second current flows past the second surface so that turbulence within the slice chamber is reduced. The invention resides in the provision of a plurality of parallel-spaced grooves defined by at least one surface of the sheet. The grooves extend in a direction from the upstream to the downstream end of the sheet for inhibiting the formation of machine direction vortices adjacent to the sheet such that when the first and the second currents interface downstream relative to the downstream end of the sheet, migration between the first and the second stocks is minimized, thereby reducing streaking in the resultant web.

Many modifications and variations of the present invention will be readily apparent to those skilled in the art by a consideration of the detailed description contained hereinafter taken in conjunction with the annexed drawings. However, such modification and variations do not depart from the spirit and scope of the present invention as defined by the appended claims. It will be apparent to those skilled in the art that in addition to reducing the tendency for machine direction streaks to occur, the break-up of larger scale vortices into smaller scale structures would improve the small scale orientation of fibers in the sheet and promote stronger internal bonding. The aforementioned break-up of larger scale vortices would be especially useful in improving ply bonding of multi-ply paper.

BRIEF DESCRIPTION OF THE DRAWINGS:

Similar reference characters refer to similar parts throughout the various embodiments of the present invention.

Figure 1:
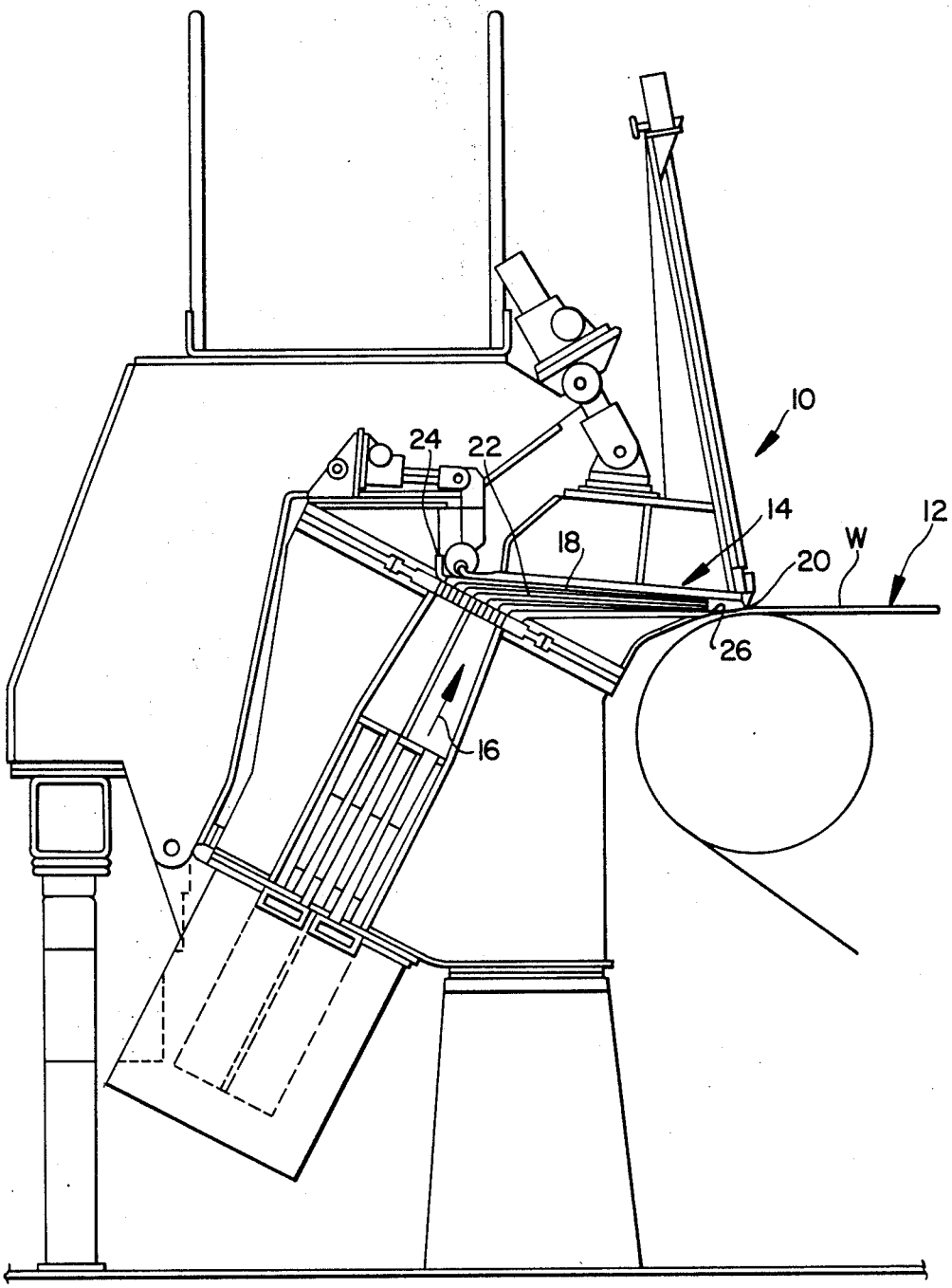
FIG. 1 is a side-elevational view partly in section of a STRATAFLO headbox according to the present invention.

DETAILED DESCRIPTION OF THE DRAWINGS:

FIG. 1 is a side-elevational view in section of a headbox generally designated 10 of a web forming apparatus generally designated 12. The headbox 10 includes a trailing element device generally designated 14 for dividing a flow of stock indicated by the arrow 16 flowing through a slice chamber 18 of the headbox 10. The trailing element device 14 includes at least one rectangular sheet 22 having an upstream and a downstream end 24 and 26 respectively.

Figure 2:
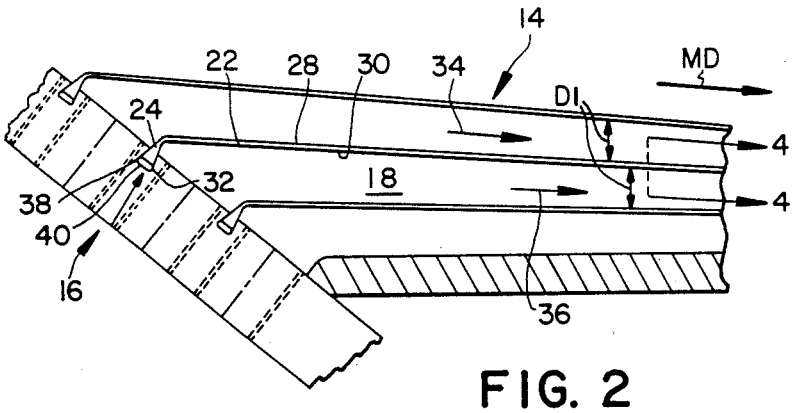
FIG. 2 is an enlarged view of the upstream end of the sheet showing a bead for anchoring the sheet relative to the headbox.

FIG. 2 is an enlarged view of the device 14 and shows the elements or sheet 22. The sheet 22 has a first and a second surface 28 and 30 respectively. The upstream end 24 of the sheet 22 is pivotally secured at 32 within the slice chamber 18 for dividing the flow of stock 16 into a first and second current as indicated by the arrows 34 and 36 respectively. The downstream end 26 of the sheet 22 freely floats adjacent to the slice lip 20 such that the first current of stock 34 flows past the first surface 28 and the second current of stock 18 flows past the second surface 30 so that turbulence within the slice chamber 18 is reduced.

At least one of the surfaces 28 and 30 defines a plurality of parallel-spaced grooves to be described in more detail hereinafter. These grooves extend in a machine direction indicated by the arrow MD from the upstream end 24 to the downstream end 26 of the sheet 22 for inhibiting the formation of machine direction vortices within the flow of stock that would otherwise cause streaking of the resultant web W.

The sheet 22 is fabricated from LEXAN and a bead 38 extends in a cross-machine direction as shown in FIG. 2. The bead 38 is pivotally anchored at 32 within a channel 40 which extends in a cross-machine direction along the headbox 10. The channel 40 is disposed within the slice chamber 18 so that the sheet 22 is pivotally secured within the slice chamber 18.

The downstream end 26 of the sheet is disposed within the slice chamber 18 as shown in FIG. 2.

Figure 3:
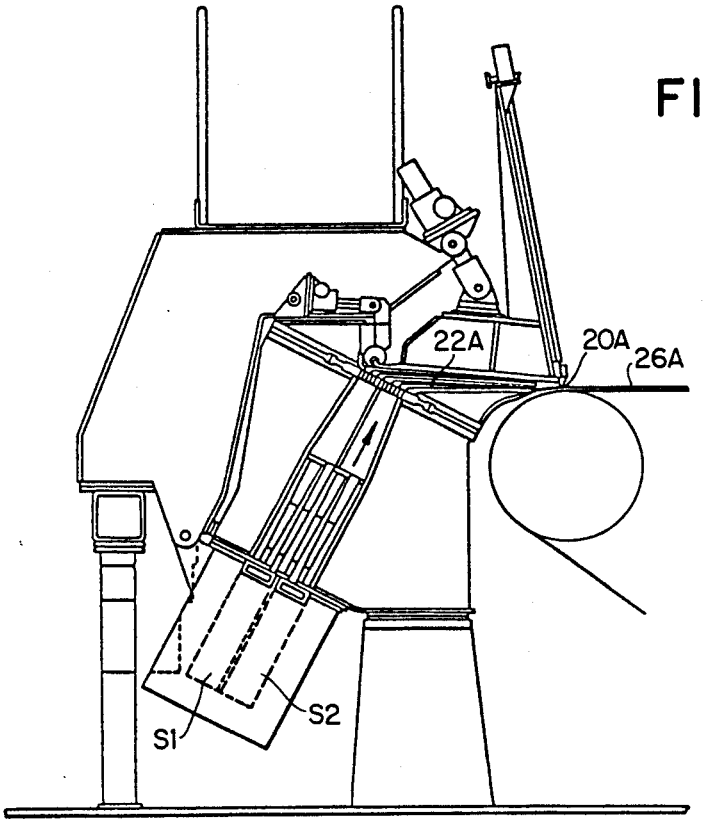
FIG. 3 is a similar view to that shown in FIG. 1 but on a reduced scale and showing the trailing elements extending through the slice lip.

However, as shown in FIG. 3, in an alternative embodiment of the present invention, the downstream end 26A of the sheet 22A is disposed downstream relative to the slice lip 20A.

Figure 4:
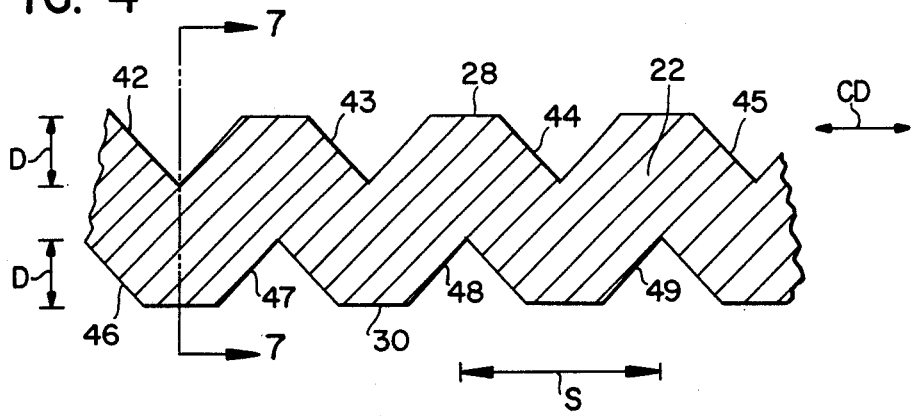
FIG. 4 is an enlarged fragmentary sectional view of a trailing element according to the present invention taken in the cross-machine direction on the line 4—4 of FIG. 2 showing V-shaped grooves.

FIG. 4 is an enlarged fragmentary sectional view taken on the line 4—4 of FIG. 2 in which the first and the second surfaces 28 and 30 of the sheet 22 define respectively a first plurality of grooves 42, 43, 44 and 45 and a second plurality of grooves 46, 47, 48 and 49. The grooves 42–45 and 46–49 are parallel-spaced grooves which extend in a direction from the upstream end 24 to the downstream end 26 of the sheet 22 for inhibiting the formation of machine direction vortices within the first and the second currents 34 and 36 respectively that would otherwise cause streaking of the resultant web W.

The first current 34 is of a first stock 51 as shown in FIG. 1, and the second current 36 is of a second stock 52 such that the sheet 22 separates the first stock S1 from the second stock S2. The arrangement is such that, formation of machine direction vortices along the surfaces 28 and 30 is inhibited by the first and second plurality of grooves 42–45 and 46–49 so that when the first and second stocks S1 and S2 interface downstream relative the downstream end 26 of the sheet 22, migration between the stocks S1 and S2 is minimized, thereby reducing streaking in the resultant web W.

As shown in FIG. 4, each of the grooves 42–45 and 46–49 of the first and second plurality of grooves has a depth D which is less than the depth D1 of the currents 34 and 36 flowing past the grooves 42–45 and 46–49 in the vicinity of the downstream end 26 of the sheet 22.

As shown in FIG. 4, each of the grooves 42 to 45 of the first plurality of grooves and 46 to 49 of the second plurality of grooves is of V-shaped configuration with the V-shaped grooves having an included angle within the range 80 to 100 degrees and preferably 90 degrees.

Each of the V-shaped grooves 42–45 and 46–49 has a depth D within the range 0.03 to 0.05 inches and the grooves are spaced center to center as indicated at S within the range 0.12 to 0.13 inches.

Figure 5:
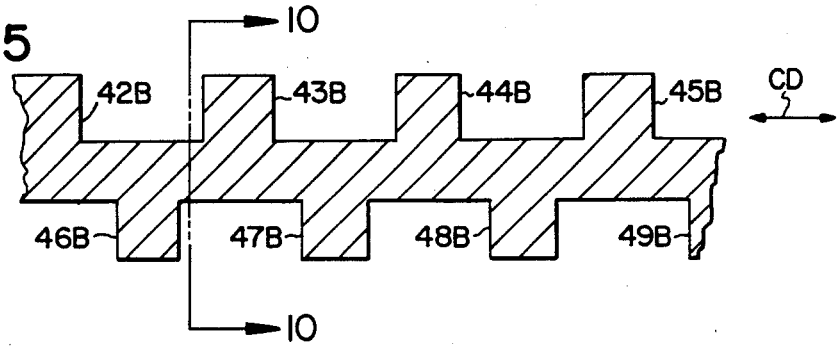
FIG. 5 is a similar view to that shown in FIG. 4 but shows an alternative embodiment of the present invention in which the grooves are of rectangular configuration.

In an alternative embodiment of the present invention as shown in FIG. 5, each of the grooves 42B, 43B, 44B and 45B, and 46B, 47B, 48B and 49B is of rectangular configuration in a cross-machine direction as indicated by the arrow CD.

Figure 6:
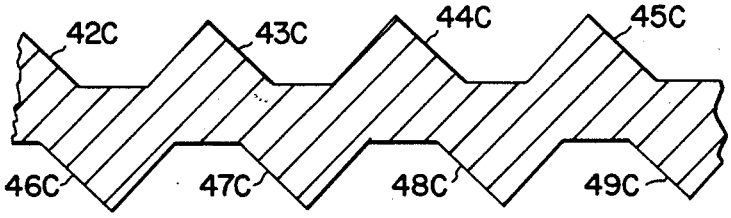
FIG. 6 is a similar view to that shown in FIG. 4 but shows an alternative embodiment of the present invention in which the grooves are of prismatic configuration.

In another embodiment of the present invention as shown in FIG. 6, each of the grooves 42C, 43C, 44C and 45C, and 46C, 47C, 48C and 49C is of prismatic configuration in a cross-machine direction CD.

Figure 7:
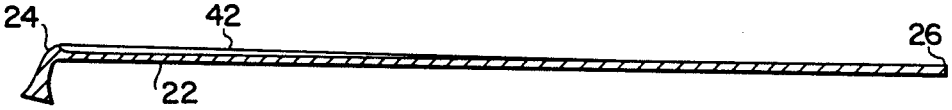
FIG. 7 is a sectional view taken on the line 7—7 of FIG. 4 showing the grooves extending from the upstream end to the downstream end of the sheet.

FIG. 7 is a sectional view taken on the line 7—7 of FIG. 4 in which each of the grooves 42–45 extends from the upstream end 24 to the downstream 26 of the sheet 22.

Figure 8:
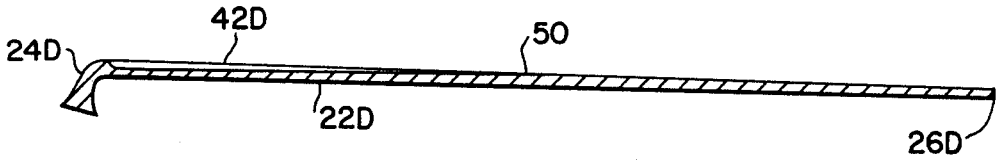
FIG. 8 is a sectional view similar to that shown in FIG. 7 but wherein the grooves extend from the upstream end of the sheet and terminate short of the downstream end thereof.

In another embodiment of the present invention, as shown in FIG. 8, the groove 42 extends from the upstream end 24D of the sheet 22D and terminates at 50 short of the downstream end 26D of the sheet 22D.

Figure 9:
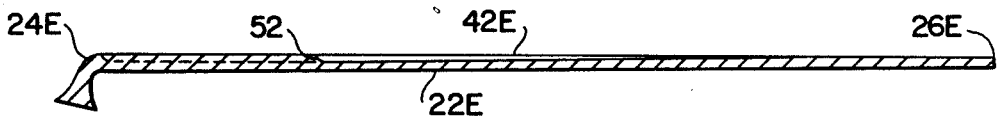
FIG. 9 is a similar view to that shown in FIG. 7 but shows the grooves extending from between the upstream and downstream ends of the sheet to the downstream end of the sheet.

In yet another embodiment of the present invention, as shown in FIG. 9, the groove 42E extends from 52 which is between the upstream end 24E and the downstream end 26E of the sheet 22E to the downstream end 26E of the sheet 22E.

The grooves 42, 42B–42E to 49, 49B–49E may be formed by either machining the sheet or may be formed by a molding technique such that the grooves are integrally formed with the sheet. Alternatively, the grooves are formed by extruding the sheet with the grooves formed therein.

Another way of forming the grooves is by etching the grooves into the sheet or by pressing a heated die against the sheet in order to form the grooves therein.

As shown in FIGS. 4, 5 and 6, the first plurality of grooves are offset relative to the second plurality of grooves such that rigidity of the sheet in a cross-machine direction is maintained.

Figure 10:
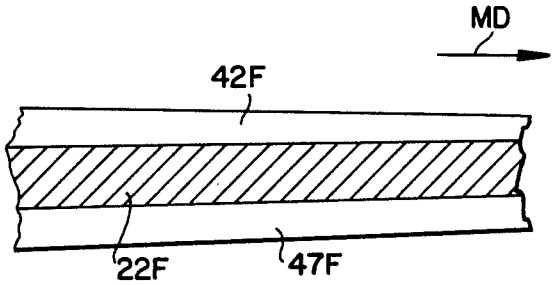
FIG. 10 is an enlarged fragmentary sectional view taken on the line 10—10 of FIG. 5 but in which the element is tapered from the upstream towards the downstream end thereof.

FIG. 10 is an enlarged fragmentary view taken on the line 10—10 of FIG. 5 but shows a further embodiment of the present invention in which the sheet 22F is tapered in a machine direction from the upstream end to the downstream end thereof.

The present invention provides a relatively simple and low cost means of overcoming the problem caused by vortices generated within a headbox slice chamber adjacent to a trailing element thereof, thereby resulting in a formed web having minimum streaking thereof.

What is claimed is:

1. In a headbox of a web forming apparatus, a trailing element device for dividing a flow of stock flowing through a slice chamber of said headbox towards a slice lip of said headbox, said trailing element device comprising:

a rectangular sheet having an upstream and a downstream end and a first and a second surface;

said upstream end of said sheet being pivotally secured within said slice chamber for dividing the flow of stock into a first and a second current;

said downstream end of said sheet freely floating adjacent to the slice lip such that said first current of stock flows past said first surface and said second current of stock flows past said second surface so that turbulence within the slice chamber is reduced;

said first and second surfaces of said sheet defining respectively a first and a second plurality of parallel-spaced grooves extending in a direction from said upstream to said downstream end of said sheet for inhibiting the formation of machine direction vortices within said first and second currents respectively that would otherwise cause streaking of the resultant web; and each of said grooves extending from said upstream end of said sheet and terminating short of said downstream end of said sheet.

2. A trailing element device as set forth in claim 1 wherein said sheet is fabricated from LEXAN.

3. A trailing element device as set forth in claim 1 wherein said upstream end of said sheet further includes:

a bead extending in a cross-machine direction, said bead being pivotally anchored within a channel extending in a cross-machine direction along the headbox, said channel being disposed within the slice chamber so that said sheet is pivotally secured within the slice chamber.

4. A trailing element device as set forth in claim 1 wherein said downstream end of said sheet is disposed within the slice chamber.

5. A trailing element device as set forth in claim 1 wherein said downstream end of said sheet is disposed downstream relative to the slice lip.

6. A trailing element device as set forth in claim 1 wherein said first current is of a first stock and said second current is of a second stock such that said sheet separates said first stock from said second stock such that, formation of said machine direction vortices along said surfaces is inhibited by said first and second plurality of grooves so that when said first and second stocks interface downstream relative to said downstream end of said sheet, migration between said stocks is minimized, thereby reducing streaking in the resultant web.

7. A trailing element device as set forth in claim 1 wherein each of said grooves of said first and second plurality of grooves has a depth which is less than the depth of said current flowing past said groove in the vicinity of said downstream end of said sheet.

8. A trailing element device as set forth in claim 1 wherein each of said grooves of said first and second plurality of grooves is of V-shaped configuration.

9. A trailing element device as set forth in claim 8 wherein each of said V-shaped grooves has an included angle within the range 80 to 100 degrees.

10. A trailing element device as set forth in claim 9 wherein each of said V-shaped grooves has a depth within the range 0.03 to 0.05 inches, said grooves being spaced center to center within the range 0.12 to 0.13 inches from an adjacent groove.

11. A trailing element device as set forth in claim 1 wherein each of said grooves is of rectangular configuration in a cross-machine direction.

12. A trailing element device as set forth in claim 1 wherein each of said grooves is of prismatic configuration in a cross-machine direction.

13. A trailing element device as set forth in claim 1 wherein each of said grooves is a machined groove.

14. A trailing element device as set forth in claim 1 wherein each of said grooves is a molded groove such that said grooves are integrally formed with said sheet.

15. A trailing element device as set forth in claim 1 wherein each of said grooves is an extruded groove.

16. A trailing element device as set forth in claim 1 wherein each of said grooves is an etched groove.

17. A trailing element device as set forth in claim 1 wherein each of said grooves is a heated die cut groove.

18. A trailing element device as set forth in claim 1 wherein said first plurality of grooves are offset relative to said second plurality of grooves such that rigidity of said sheet in a cross-machine direction is maintained.

* * * * *